US009620100B2

(12) United States Patent
Ochipa

(10) Patent No.: US 9,620,100 B2
(45) Date of Patent: Apr. 11, 2017

(54) ACOUSTIC AMPLIFICATION SYSTEM FOR A SHOE

(71) Applicant: S9, LLC, Fort Myers, FL (US)

(72) Inventor: Matthew Ochipa, Hollywood, FL (US)

(73) Assignee: S9, LLC, Fort Myers, FL (US)

( * ) Notice: Subject to any disclaimer, the term of this patent is extended or adjusted under 35 U.S.C. 154(b) by 0 days.

(21) Appl. No.: 15/159,730

(22) Filed: May 19, 2016

(65) Prior Publication Data

US 2016/0343364 A1 Nov. 24, 2016

Related U.S. Application Data

(60) Provisional application No. 62/165,404, filed on May 22, 2015.

(51) Int. Cl.
*G10K 11/08* (2006.01)
*A43B 13/14* (2006.01)

(52) U.S. Cl.
CPC ..... *G10K 11/08* (2013.01); *A43B 13/14* (2013.01)

(58) Field of Classification Search
CPC ..... A43B 13/14; G10K 11/08
USPC ..... 36/137; 181/179; 381/364
See application file for complete search history.

(56) References Cited

U.S. PATENT DOCUMENTS 895,853 A 8/1908 Haines
1,613,511 A 10/1924 Graham
5,159,768 A * 11/1992 Longo, Jr. ..... A43B 3/0021 36/136
5,345,700 A 9/1994 Norment
5,615,111 A * 3/1997 Raskas ..... A43B 3/00 36/136
5,765,300 A * 6/1998 Kianka ..... A43B 3/0005 36/139
6,000,149 A * 12/1999 Pomerantz ..... A43B 3/00 36/136
7,059,070 B2 6/2006 Omstead et al.
7,997,007 B2 * 8/2011 Sanabria-Hernandez ..... A43B 3/0005 36/1
8,385,568 B2 2/2013 Goel et al.
8,412,289 B1 4/2013 Oh
(Continued)

OTHER PUBLICATIONS

U.S. Appl. No. 62/165,404, filed May 22, 2015.
(Continued)

*Primary Examiner* — Jeremy Luks
(74) *Attorney, Agent, or Firm* — Craig R. Miles; CR Miles P.C.

(57) ABSTRACT

Disclosed herein are embodiments of an acoustic amplification system for a shoe which includes an amplifier configured to couple to a sole portion of the shoe. The amplifier includes a body; an open-ended cavity disposed within the body; and a sound wave-amplifying conduit disposed within the body, the sound wave-amplifying conduit having opposing inlet and outlet ports, whereby the inlet port acoustically couples to the open-ended cavity and the outlet port acoustically couples to an ambient environment. Following, sound waves entering the inlet port from a sound wave-generating device received within the open-ended cavity are amplified within the sound wave-amplifying conduit to generate amplified sound waves which exit from the outlet port into the ambient environment, the amplified sound waves providing amplified sound.

19 Claims, 6 Drawing Sheets

(56) References Cited

U.S. PATENT DOCUMENTS

| | | | | |
|---|---|---|---|---|
| 8,477,953 | B2 | 7/2013 | Hobson et al. | |
| 8,638,958 | B2 | 1/2014 | Wells | |
| 8,879,759 | B2 * | 11/2014 | Wells | A43B 3/0021 36/139 |
| 2002/0009195 | A1 | 1/2002 | Schon | |
| 2005/0091884 | A1 * | 5/2005 | Omstead | A43B 1/0036 36/137 |
| 2009/0238400 | A1 * | 9/2009 | Im | A43B 3/0005 381/388 |
| 2010/0115799 | A1 * | 5/2010 | Welter | A43B 3/0005 36/137 |
| 2011/0023331 | A1 * | 2/2011 | Kolodjski | A43B 3/0021 36/139 |
| 2011/0305357 | A1 * | 12/2011 | Wells | H04R 1/025 381/301 |
| 2011/0306299 | A1 | 12/2011 | Wells | |
| 2012/0140970 | A1 * | 6/2012 | Kim | H04R 1/30 381/340 |
| 2013/0175307 | A1 | 7/2013 | Izen et al. | |
| 2013/0276334 | A1 * | 10/2013 | Bellone | A43B 3/001 36/136 |
| 2014/0056443 | A1 | 2/2014 | Yui et al. | |
| 2014/0069736 | A1 | 3/2014 | Freshman et al. | |

OTHER PUBLICATIONS amazon.com. Asobu the Beat Silicone Bottle with Sport Lid. Website, http://www.amazon.com, originally downloaded May 9, 2016, total 3 pages.

PCT International patent application No. PCT/US16/33486; International Search Report and Written Opinion of the International Searching Authority, mailed Sep. 1, 2016.

* cited by examiner

1/5

1/5

1/5

1/5

1/5

FIG. 11 1/5
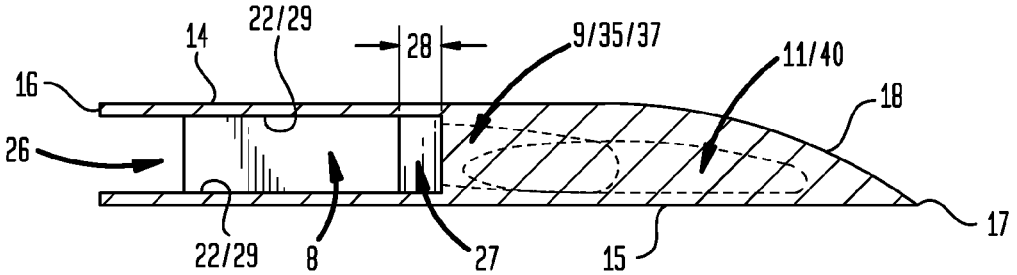
FIG. 12 1/5
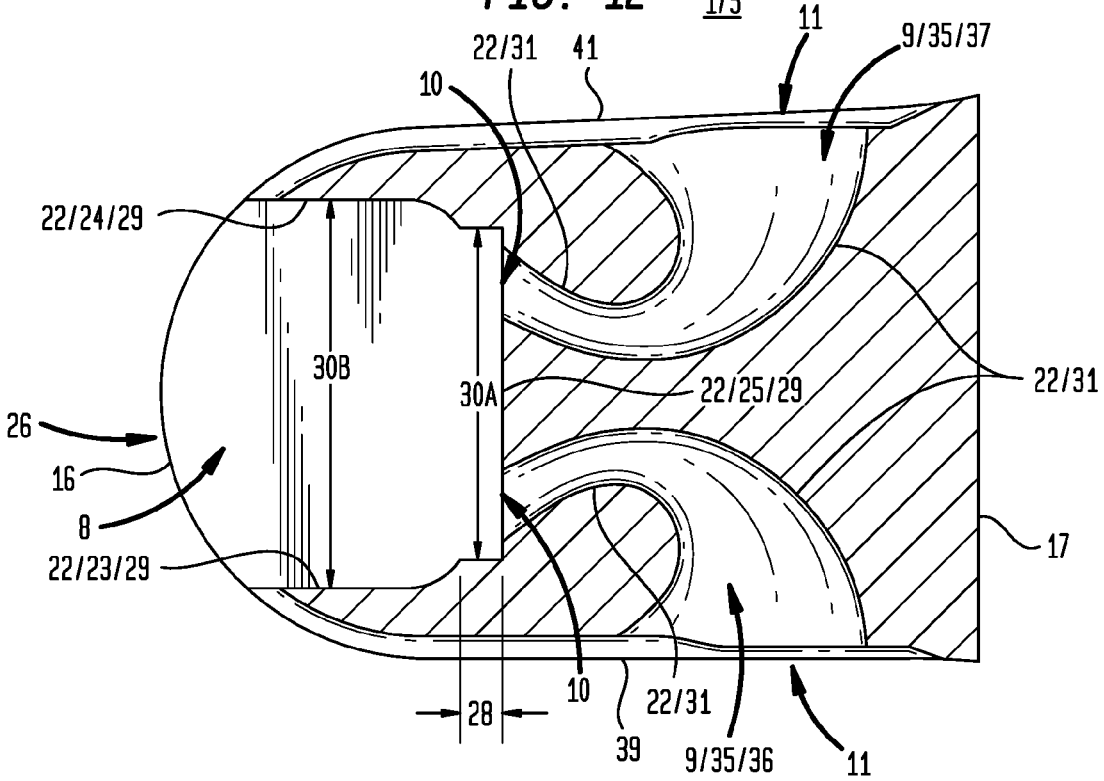
FIG. 13
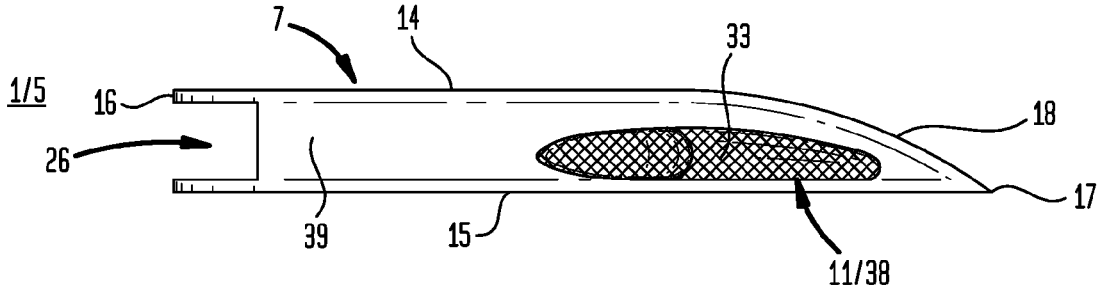

ACOUSTIC AMPLIFICATION SYSTEM FOR A SHOE

This United States Non-Provisional Patent Application claims the benefit of U.S. Provisional Patent Application No. 62/165,404, filed May 22, 2015, hereby incorporated by reference herein.

I. BACKGROUND

Electronic portable devices, such as smartphones, typically include speakers which may not provide adequate sound. Following, a need exists for an acoustic amplification system capable of amplifying sound waves generated by such devices, whereby the acoustic amplification system functions to passively amplify sound waves to provide amplified sound.

II. SUMMARY OF THE INVENTION

Accordingly, a broad object of a particular embodiment of the invention can be to provide an acoustic amplification system for a shoe, and methods of making and using such an acoustic amplification system, whereby the acoustic amplification system includes an amplifier configured to couple to a sole portion of the shoe. The amplifier includes a body; an open-ended cavity disposed within the body; and a sound wave-amplifying conduit disposed within the body, the sound wave-amplifying conduit having opposing inlet and outlet ports, whereby the inlet port acoustically couples to the open-ended cavity and the outlet port acoustically couples to an ambient environment.

Following, sound waves entering the inlet port from a sound wave-generating device received within the open-ended cavity are amplified within the sound wave-amplifying conduit to generate amplified sound waves which exit from the outlet port into the ambient environment, the amplified sound waves providing amplified sound.

Naturally, further objects of the invention are disclosed throughout other areas of the specification, drawings, and claims.

III. A BRIEF DESCRIPTION OF THE DRAWINGS

FIG. 11 is a cross-sectional view 11-11 of the particular embodiment of the amplifier of the acoustic amplification system shown in FIG. 4.

FIG. 12 is a cross-sectional view 12-12 of the particular embodiment of the amplifier of the acoustic amplification system shown in FIG. 4.

FIG. 13 is a first side view of a particular embodiment of an amplifier of the acoustic amplification system, whereby a covering overlays an outlet port of a sound wave-amplifying conduit disposed within a body of the amplifier.

IV. DETAILED DESCRIPTION OF THE PREFERRED EMBODIMENTS

Figure 1:
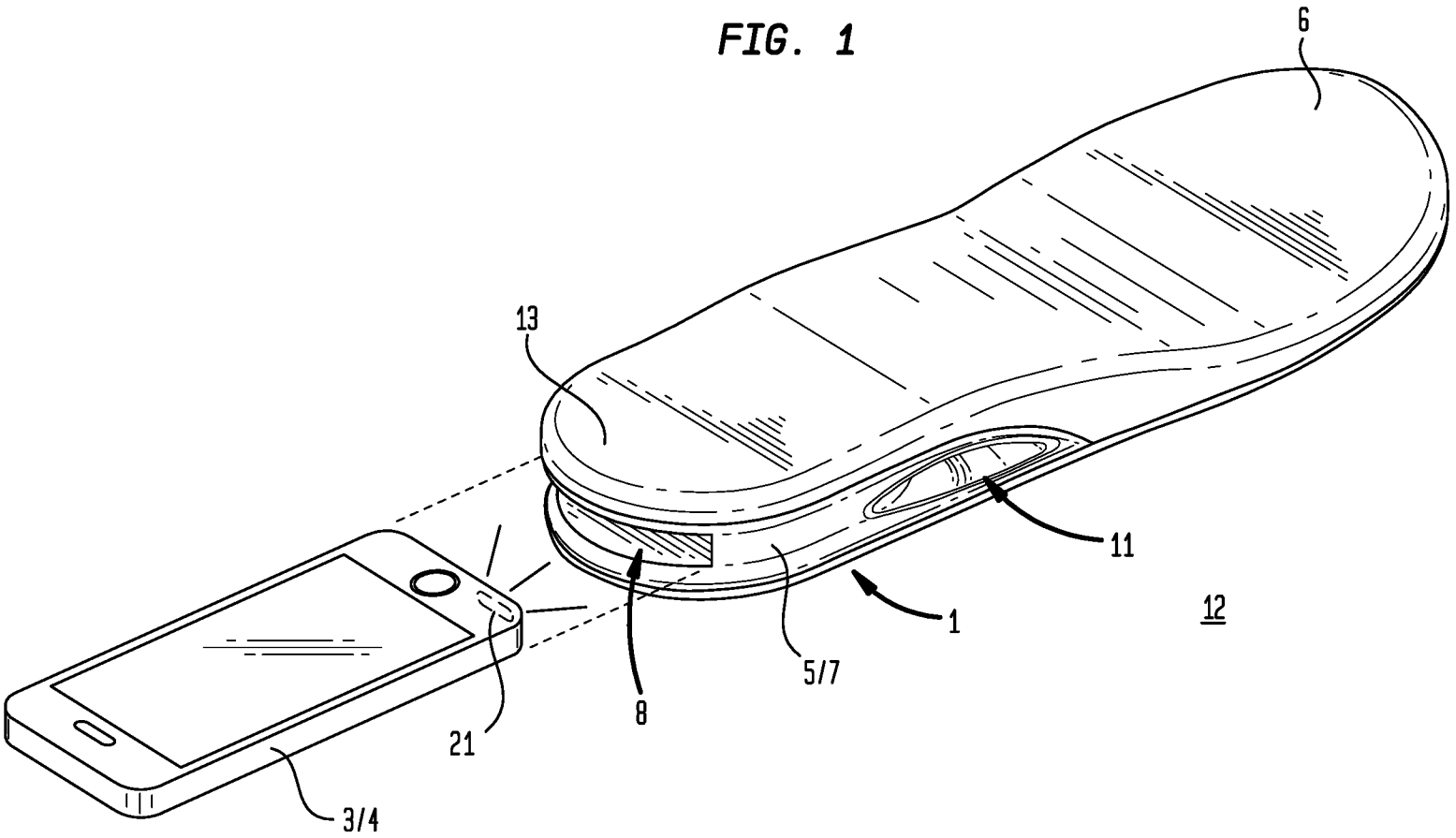
FIG. 1 is an illustration of a method of using a particular embodiment of the acoustic amplification system, whereby a sound wave-generating device is shown exploded out from an open-ended cavity disposed within a body of an amplifier.

Now referring primarily to FIG. 1, which illustrates a method of using a particular embodiment of an acoustic amplification system (1) for a shoe to amplify sound waves generated by a sound wave-generating device (3), for example a portable electronic device such as a smartphone (4), whereby the acoustic amplification system (1) includes an amplifier (5) configured to couple to a sole portion (6) for incorporation into the shoe. The amplifier (5) includes a body (7), an open-ended cavity (8) disposed within the body (7), and a sound wave-amplifying conduit (9) disposed within the body (7), whereby the sound wave-amplifying conduit (9) has opposing inlet and outlet ports (10) (11). The inlet port (10) acoustically couples to the open-ended cavity (8) and the outlet port (11) acoustically couples to an ambient environment (12).

Again referring primarily to FIG. 1, the method of using a particular embodiment of an acoustic amplification system (1) can include obtaining the acoustic amplification system (1), disposing the sound wave-generating device (3) within the open-ended cavity (8), and operating the sound wave-generating device (3) to generate sound waves.

The term "sound" as used herein means a vibration that propagates as a typically audible mechanical wave of pressure, or "sound wave", through a medium. Sound is the reception and perception of such waves.

The term "sole portion" as used herein means a portion for incorporation into a shoe or a portion of a shoe which disposes between a wearer's foot and a ground surface when the shoe is worn by the wearer. As illustrative examples, the sole portion (6) can be an outsole, a midsole, an insole, combinations thereof, or any additional layers of a shoe which dispose between the wearer's foot and the ground surface when the shoe is worn by the wearer.

Now referring primarily to FIG. 2 through FIG. 12, the acoustic amplification system (1) for a shoe includes an amplifier (5) configured to couple to a sole portion (6) of the shoe. As described above, the amplifier (5) includes a body (7), an open-ended cavity (8) disposed within the body (7), and a sound wave-amplifying conduit (9) disposed within the body (7), whereby the sound wave-amplifying conduit (9) has opposing inlet and outlet ports (10) (11). The inlet port (10) acoustically couples to the open-ended cavity (8) and the outlet port (11) acoustically couples to an ambient environment (12), which is external to the body (7).

Sound waves entering the inlet port (10) from a sound wave-generating device (3) received within the open-ended cavity (8) are amplified within the sound wave-amplifying conduit (9) to generate amplified sound waves which exit from the outlet port (11) into the ambient environment (12), whereby the amplified sound waves provide amplified sound.

Again referring primarily to FIG. 2 through FIG. 12, the amplifier (5) includes a body (7), which can have any of a numerous and wide variety of configurations with varying dimensions, whereby the configurations can be capable of coupling to a sole portion (6) of a shoe.

Figure 2:
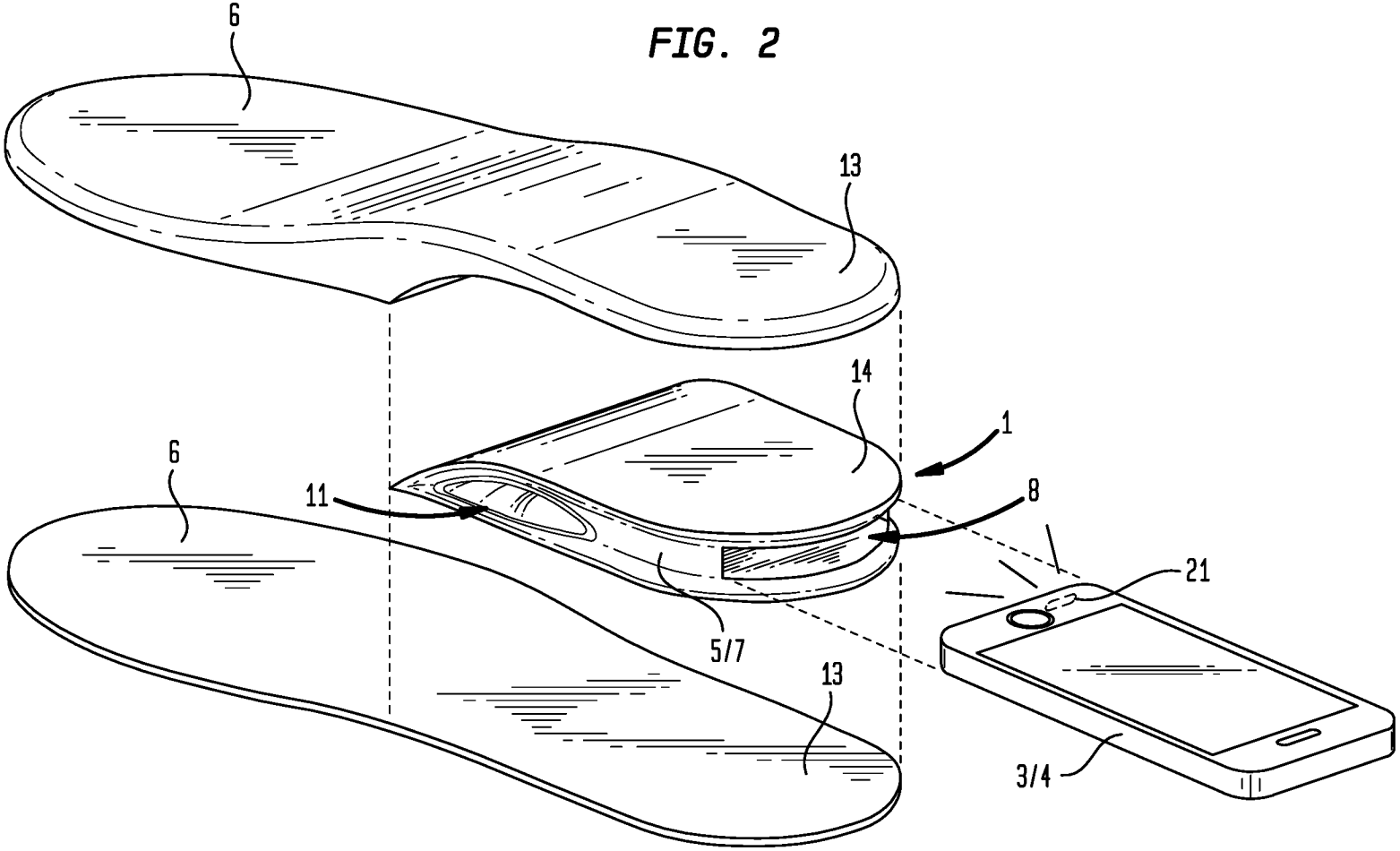
FIG. 2 is an exploded top perspective view of a particular embodiment of the acoustic amplification system, whereby a sound wave-generating device is shown exploded out from an open-ended cavity disposed within a body of an amplifier, and the amplifier is shown exploded out from within a sole portion of a shoe.
Figure 3:
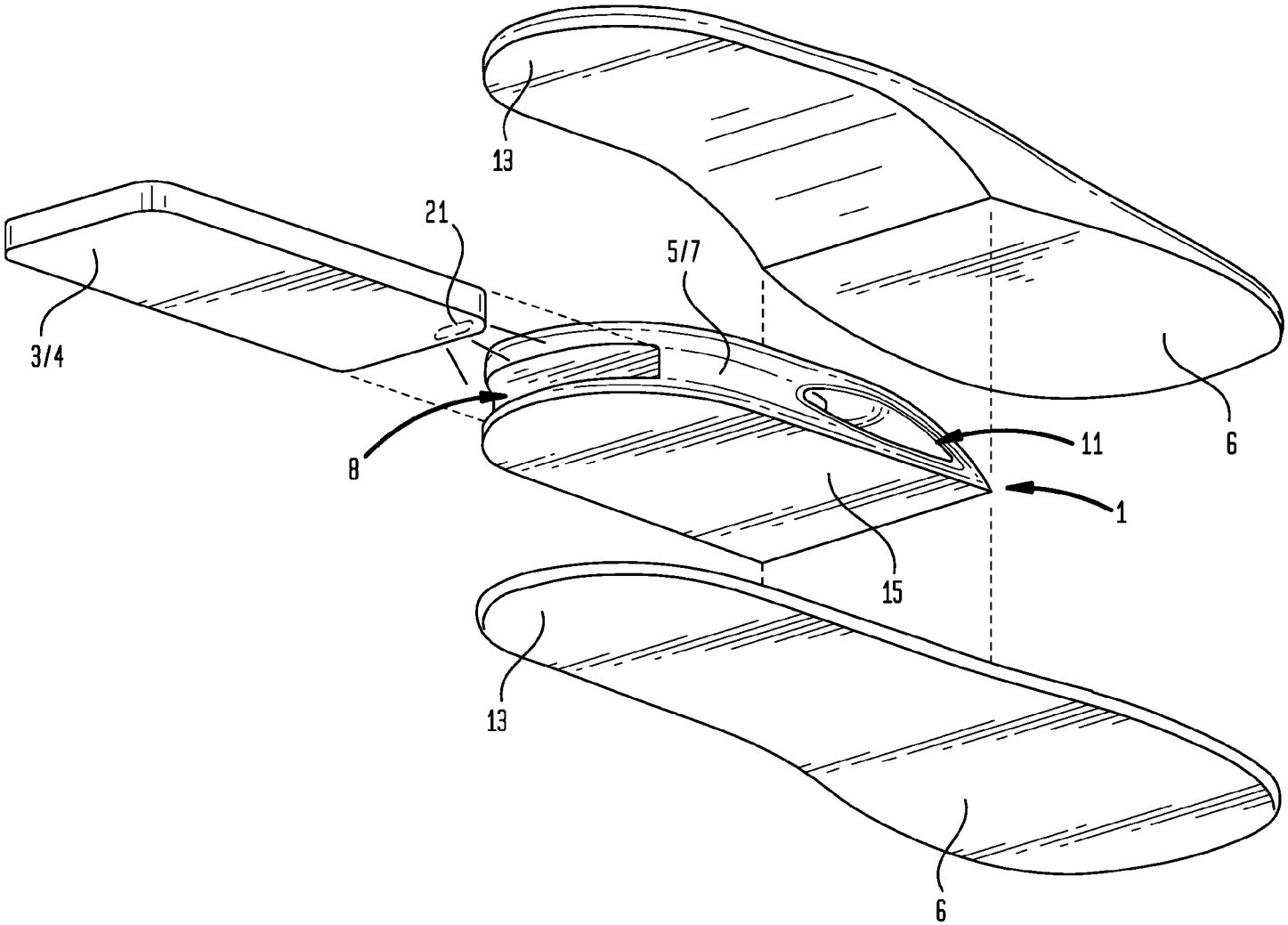
FIG. 3 is an exploded bottom perspective view of the particular embodiment of the acoustic amplification system shown in FIG. 2.
Figure 4:
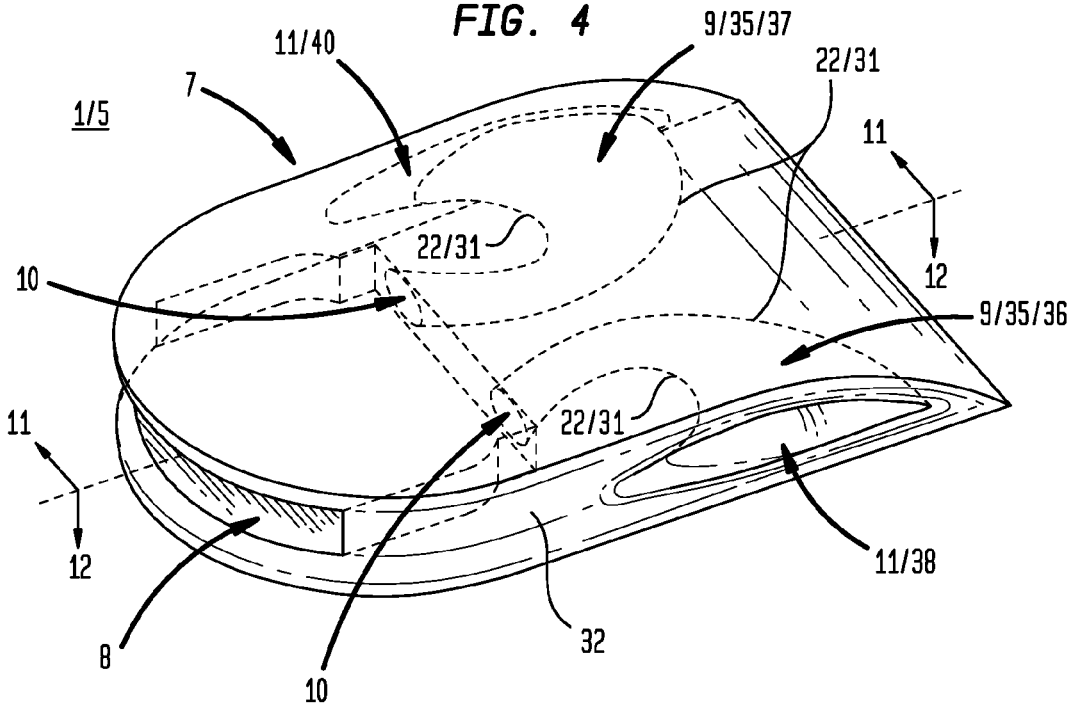
FIG. 4 is a perspective view of a particular embodiment of an amplifier of the acoustic amplification system.
Figure 5:
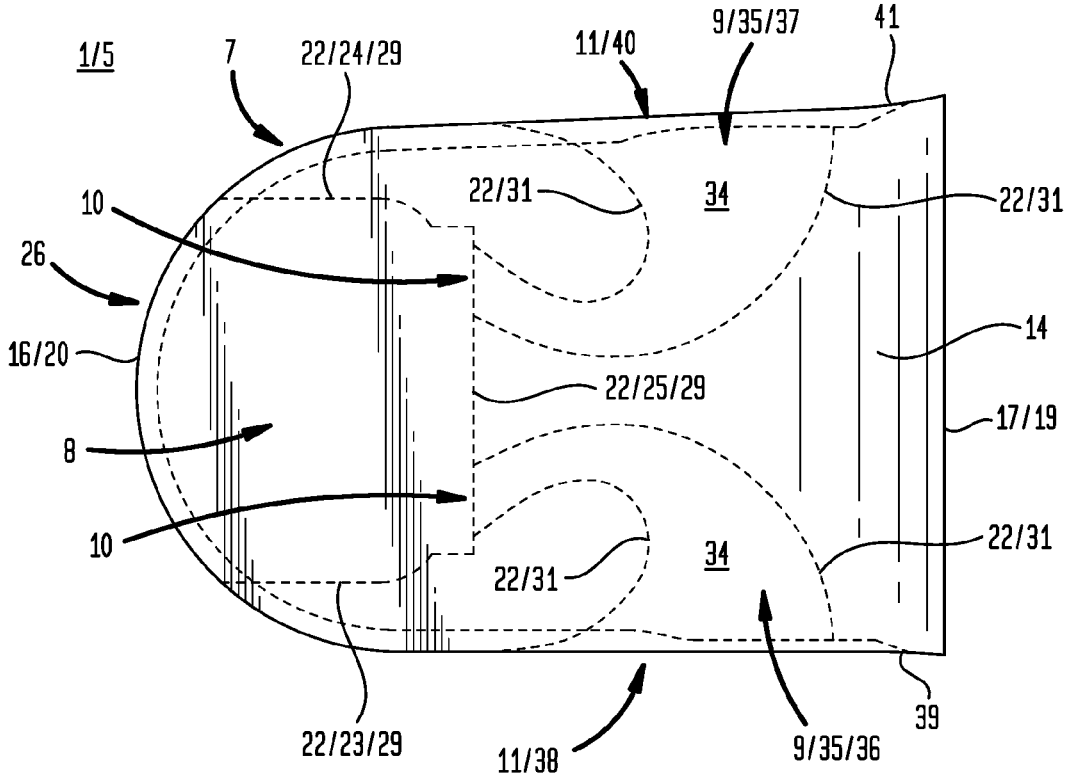
FIG. 5 is a top view of the particular embodiment of the amplifier shown in FIG. 4.
Figure 6:
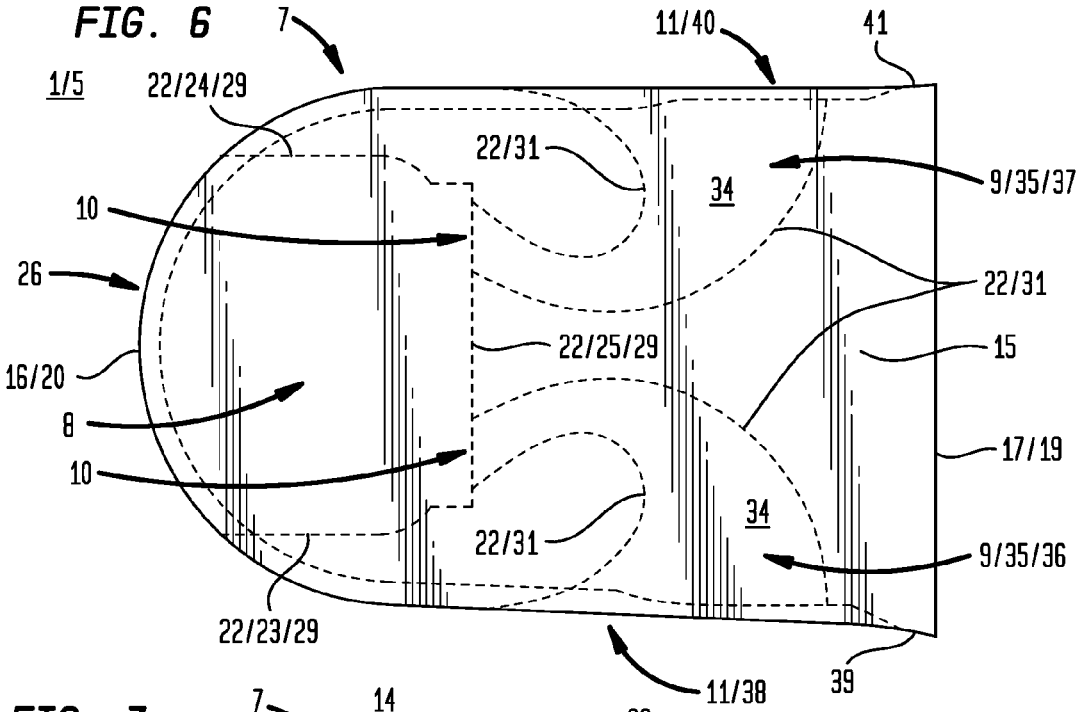
FIG. 6 is a bottom view of the particular embodiment of the amplifier shown in FIG. 4.
Figure 7:
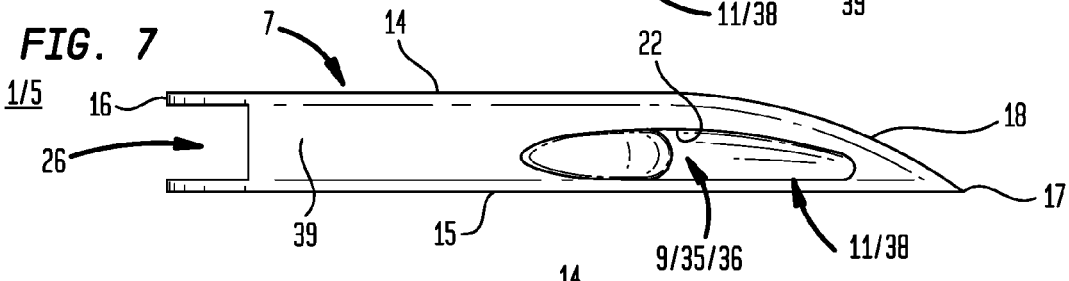
FIG. 7 is a first side view of the particular embodiment of the amplifier shown in FIG. 4.
Figure 8:
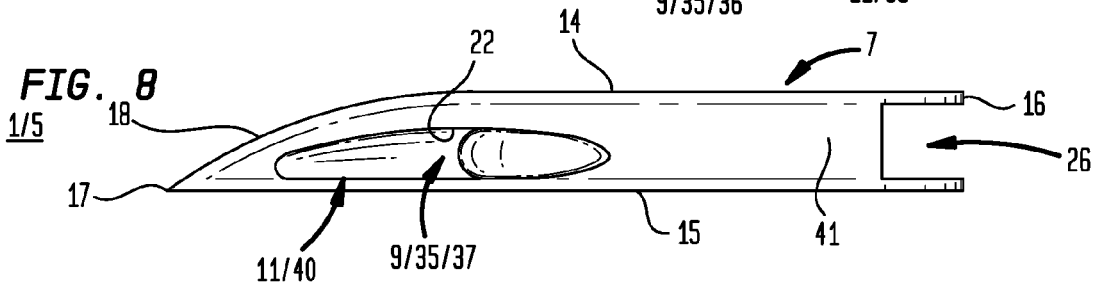
FIG. 8 is a second side view of the particular embodiment of the amplifier shown in FIG. 4.
Figure 9:
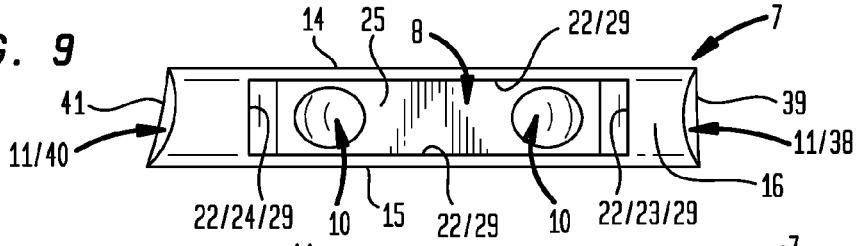
FIG. 9 is a first end view of the particular embodiment of the amplifier shown in FIG. 4.
Figure 10:
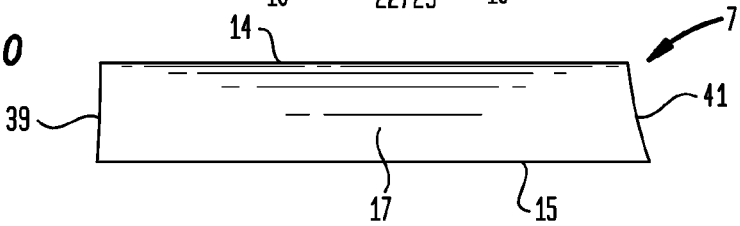
FIG. 10 is a second end view of the particular embodiment of the amplifier shown in FIG. 4.

Now referring primarily to FIG. 2 and FIG. 3, as but one illustrative example, the body (7) can be configured to overlay a sole portion (6) or to couple between a pair of sole portions (6), whereby the body (7) disposes proximate an arcuate heel-accommodating portion (13) of the sole portion (6). The body (7) can be defined by body upper and lower faces (14) (15) which terminate in opposing body first and second ends (16) (17). As to this particular embodiment, the body lower face (15) can be generally planar and the body upper face (14) can have a body upper face arcuate portion (18) such that the body (7) tapers toward the body second end (17), which can have a generally linear body second end periphery (19). Conversely, the body first end (16) can have a generally arcuate body first end periphery (20) contoured to extend in generally adjacent parallel relation to the arcuate heel-accommodating portion (13) of the sole portion (6).

Now referring primarily to FIG. 4 through FIG. 9, FIG. 11, and FIG. 12, the amplifier (5) further includes an open-ended cavity (8) disposed within the body (7), whereby the open-ended cavity (8) is configured to insertingly receive and releasably retain a portion or an entirety of a sound wave-generating device (3). Accordingly, the open-ended cavity (8) can have dimensional relations which can be similar to or slightly greater than the portion or the entirety of the sound wave-generating device (3) which the open-ended cavity (8) is configured to insertingly receive and releasably retain, thereby facilitating frictional engagement between the wall bounding the open-ended cavity (8) and the sound wave-generating device (3).

As but one illustrative example, the open-ended cavity (8) can have a generally rectangular cross-section which can insertingly receive and releasably retain a sound-wave generating device (3) which has a corresponding generally rectangular cross-section.

Any sound wave-generating device (3) insertingly receivable and releasably retainable within the open-ended cavity (8) of the body (7) can be used with the instant acoustic amplification system (1). As a non-limiting example, the sound wave-generating device (3) can be configured as a portable electronic device, such as a mobile phone with an advanced mobile operating system, generally known as a smartphone (4). As to particular embodiments, smartphones (4) can generates sounds including, but not limited to, voice, music, audio transmission associated with a video or a game, or the like, or combinations thereof. Typically, the sound wave-generating device (3) emits sound waves from a speaker (21), which can be located in various locations, depending upon the particular sound wave-generating device (3).

Again referring primarily to FIG. 4 through FIG. 9, FIG. 11, and FIG. 12, the open-ended cavity (8) can be defined by a body internal surface (22) of the body (7). As to particular embodiments, the body internal surface (22) can bound the open-ended cavity (8) on open-ended cavity first and second sides (23)(24) and on an open-ended cavity closed end (25), which disposes opposite an open-ended cavity open end (26). Accordingly, the sound-wave generating device (3) can be insertingly received within the open-ended cavity (8) by passing a portion or an entirety of the sound wave-generating device (3) through the open-ended cavity open end (26) toward the open-ended cavity closed end (25).

Upon reception and releasable retention of the sound-wave generating device (3), the open-ended cavity (8) can be configured to locate the speaker (21) of the sound wave-generating device (3) proximate an inlet port (10) of a sound wave-amplifying conduit (9), whereby the inlet port (10) is acoustically coupled to the open-ended cavity (8), to direct sound waves emitted from the speaker (21) into the sound wave-amplifying conduit (9).

Now referring primarily to FIG. 11 and FIG. 12, as to particular embodiments, the open-ended cavity (8) can, but need not necessarily, further include a spacer portion (27) proximate the open-ended cavity closed end (25) and correspondingly, proximate the inlet port (10). The spacer portion (27) can be configured to provide space between the speaker (21) of a sound wave-generating device (3) insertingly received and releasably retained within the open-ended cavity (8) and the inlet port (10), thereby disposing the speaker (21) a distance (28) from the inlet port (10). Accordingly, sound waves emitted from the speaker (21) are not muffled by a body internal surface wall (29) which defines the open-ended cavity closed end (25).

As but one illustrative example, the spacer portion (27) of the open-ended cavity (8) can be configured to have a spacer portion width (30A) which is lesser than an open-ended cavity width (30B) of the open-ended cavity (8) such that when a sound wave-generating device (3) is insertingly received and releasably retained within the open-ended cavity (8), the sound wave-generating device (3) cannot pass through the spacer portion (27), being precluded by the lesser spacer portion width (30). Accordingly, the speaker (21) of the sound wave-generating device (3) insertingly received and releasably retained within the open-ended cavity (8) disposes a distance (28) from the inlet port (10).

Now referring primarily to FIG. 4 through FIG. 6, FIG. 11, and FIG. 12, the amplifier (5) further includes a sound wave-amplifying conduit (9) disposed within the body (7), the sound wave-amplifying conduit (9) having opposing inlet and outlet ports (10) (11). The inlet port (10) acoustically couples to the open-ended cavity (8) and the outlet port (11) acoustically couples to an ambient environment (12), which is external to the body (7).

As to particular embodiments, the sound wave-amplifying conduit (9) can be defined by the body internal surface (22), whereby the body internal surface (22) provides a tubular wall (31) of the sound wave-amplifying conduit (9), the tubular wall (31) disposed between the opposing inlet and outlet ports (10) (11).

Now referring primarily to FIG. 2 through FIG. 8, FIG. 11, and FIG. 12, as to particular embodiments, the outlet port (11) can be disposed proximate a body side wall (32) of the body (7). Accordingly, amplified sound waves, generated from sound waves entering the inlet port (10) and amplified within the sound wave-amplifying conduit (9), exit from the outlet port (11) proximate the body side wall (32) to provide amplified sound emanating from proximate the body side wall (32).

As to particular embodiments, a cover or covering (33) can overlay the outlet port (11) to preclude matter, such as particulate matter, from entering the outlet port (11) and corresponding, the sound wave-amplifying conduit (9), from the ambient environment (12).

Now referring primarily to FIG. 13, as to particular embodiments, the covering (33) can be formed from mesh or a mesh-like material to allow sound waves to exit from the outlet port (11) while precluding matter, such as particulate matter, from entering the outlet port (11) and corresponding, the sound wave-amplifying conduit (9), from the ambient environment (12).

Now referring primarily to FIG. 4 through FIG. 6, and FIG. 12, as to particular embodiments, the sound wave-amplifying conduit (9) can be configured to increase in cross-sectional area (34) from the inlet port (10) to the outlet port (11). For example, the sound wave-amplifying conduit (9) can be configured as an acoustic horn (35), which passively amplifies sound waves to provide amplified sound. As to particular embodiments, the acoustic horn (35) can be defined by an arcuate or curved shape having one or more turns between the inlet and outlet ports (10) (11).

As to particular embodiments, the acoustic horn (35) can be defined by a shape which is optimized to preferentially amplify particular frequencies, depending upon the desired sound emission, such as frequencies associated with a pleasing music-listening experience; frequencies associated with intelligibility of human speech; or frequencies which can compensate for inefficiently reproduced frequencies, for example inefficiently reproduced frequencies reproduced by lesser quality speakers (21).

It is expressly contemplated that an application or program for the portable electronic device, such as the smartphone (4), can be provided which alters the sound waves emitted from the smartphone (4) to maximize the performance of the amplifier (5), whereby the application or program can be customized for individual smartphone models. As an illustrative example, the application or program can be used to improve the performance of certain frequencies or reduce, or completely neutralize, undesirable frequencies. The application or program can also programmable to compensate for environmental noise around the user, re-tuning the sound to overcome the surrounding noise.

Now referring primarily to FIG. 4 through FIG. 9, and FIG. 12, as to particular embodiments, the amplifier (5) can, but need not necessarily, further include a plurality of sound wave-amplifying conduits (9) disposed within the body (7). As but one non-limiting example, the amplifier (5) can include a pair of first and second sound wave-amplifying conduits (36) (37) disposed on opposing sides of the body (7), whereby the first sound wave-amplifying conduit (36) has a first sound wave-amplifying conduit outlet port (38) which disposes proximate a body first side wall (39) and the second sound wave-amplifying conduit (37) has a second sound wave-amplifying conduit outlet port (40) which disposes proximate an opposing body second side wall (41).

Regarding production, a method of making a particular embodiment of the acoustic amplification system (1) for a shoe includes providing an amplifier (5), which is configured to couple to a sole portion (6) of the shoe, by: providing a body (7); disposing an open-ended cavity (8) within the body (7); and disposing a sound wave-amplifying conduit (9) within the body (7), the sound wave-amplifying conduit (9) having opposing inlet and outlet ports (10)(11); whereby the inlet port (10) is acoustically coupled to the open-ended cavity (8) and whereby the outlet port (11) is acoustically coupled to an ambient environment (12).

The method of making the acoustic amplification system (1) can, but need not necessarily, further include providing and configuring additional elements of the acoustic amplification system (1) as above described.

The acoustic amplification system (1) or elements of the acoustic amplification system (1) can be made from any of a numerous and wide variety of materials, depending upon the application. As non-limiting examples, the material can include plastic, plastic-like material, rubber, rubber-like material, injection-moldable material, or the like, or combinations thereof.

The acoustic amplification system (1) or elements of the acoustic amplification system (1) can be made by any of a numerous and wide variety of processes, depending upon the application. As non-limiting examples, the process can include press molding, injection molding, fabrication, machining, printing, additive printing, or the like, or combinations thereof.

As to particular embodiments, the body (7), including the open-ended cavity (8) and the sound wave-amplifying conduit (9), can be configured as a one-piece body (7) to provide a one-piece construct.

As to particular embodiments, the body (7), including the open-ended cavity (8) and the sound wave-amplifying conduit (9), and the sole portion (6) of the shoe can be integrally formed, meaning connected together so as to make up a single complete piece or unit, or so as to work together as a single complete piece or unit, and so as to be incapable of being easily dismantled without destroying the integrity of the piece or unit.

Regarding use, a method of using a particular embodiment of the acoustic amplification system (1) for a shoe to amplify sound waves generated by a sound-wave generating device (3) can include obtaining the acoustic amplification system (1) as above described; inserting the sound-wave generating device (3) within the open-ended cavity (8) for releasable retention; and operating the sound-wave generating device (3) to generate sound waves. Following, the sound waves entering the inlet port (10) from the sound wave-generating device (3) releasably received within the open-ended cavity (8) are amplified within the sound wave-amplifying conduit (9) to generate amplified sound waves which exit from the outlet port (11) into the ambient environment (12), the amplified sound waves providing amplified sound.

As can be easily understood from the foregoing, the basic concepts of the present invention may be embodied in a variety of ways. The invention involves numerous and varied embodiments of an acoustic amplification system and methods for making and using such an acoustic amplification system, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of an "amplifier" should be understood to encompass disclosure of the act of "amplifying"— whether explicitly discussed or not—and, conversely, were there effectively disclosure of the act of "amplifying", such a disclosure should be understood to encompass disclosure of an "amplifier" and even a "means for amplifying". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the acoustic amplification systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. An acoustic amplification system for a shoe, comprising:

an amplifier configured to couple to a sole portion of said shoe, said amplifier comprising:

a body;

an open-ended cavity disposed within said body; and a sound wave-amplifying conduit disposed within said body, said sound wave-amplifying conduit having opposing inlet and outlet ports;

said inlet port acoustically coupled to said open-ended cavity;

said outlet port acoustically coupled to an ambient environment, wherein said open-ended cavity is configured to insertingly receive and releasably retain said sound wave-generating device.

2. The acoustic amplification system of claim 1, wherein sound waves entering said inlet port from a sound wave-generating device received within said open-ended cavity are amplified within said sound wave-amplifying conduit to generate amplified sound waves which exit from said outlet port into said ambient environment, said amplified sound waves providing amplified sound.

3. The acoustic amplification system of claim 2, wherein said body is configured to dispose proximate an arcuate heel-accommodating portion of said sole portion.

4. The acoustic amplification system of claim 3, wherein said body is defined by opposing body first and second ends, said body first end having a generally arcuate body first end periphery contoured to extend in generally adjacent parallel relation to said arcuate heel-accommodating portion of said sole portion.

5. The acoustic amplification system of claim 1, wherein said sound wave-generating device is configured as a portable electronic device.

6. The acoustic amplification system of claim 5, wherein said portable electronic device is configured as a smartphone.

7. The acoustic amplification system of claim 2, wherein said open-ended cavity is defined by a body internal surface of said body, said body internal surface defining open-ended cavity first and second sides and an open-ended cavity closed end which disposes opposite an open-ended cavity open end.

8. The acoustic amplification system of claim 7, wherein said open-ended cavity further includes a spacer portion proximate said open-ended cavity closed end and said inlet port.

9. The acoustic amplification system of claim 8, wherein a spacer portion width of said spacer portion is lesser than an open-ended cavity width of said open-ended cavity.

10. The acoustic amplification system of claim 2, wherein said sound wave-amplifying conduit is defined by a body internal surface to provides a tubular wall which disposes between said inlet and outlet ports.

11. The acoustic amplification system of claim 2, wherein said outlet port disposes proximate a body side wall of said body.

12. The acoustic amplification system of claim 2, further comprising:

a covering overlaying said outlet port.

13. The acoustic amplification system of claim 12, wherein said covering comprises mesh or a mesh-like material.

14. The acoustic amplification system of claim 2, wherein said sound wave-amplifying conduit is configured to increase in cross-sectional area from said inlet port to said outlet port.

15. The acoustic amplification system of claim 14, wherein said sound wave-amplifying conduit is configured as an acoustic horn.

16. The acoustic amplification system of claim 2, wherein said amplifier further comprises a plurality of sound wave-amplifying conduits disposed within said body.

17. The acoustic amplification system of claim 16, further comprising:

a pair of first and second sound wave-amplifying conduits disposed on opposing sides of said body;

wherein said first sound wave-amplifying conduit has a first sound wave-amplifying conduit outlet port which disposes proximate a body first side wall; and wherein said second sound wave-amplifying conduit has a second sound wave-amplifying conduit outlet port which disposes proximate an opposing body second side wall.

18. The acoustic amplification system of claim 2, wherein said body is configured as a one-piece body to provide a one-piece construct.

19. The acoustic amplification system of claim 2, wherein said body and said sole portion are integrally formed.

* * * * *